US005178082A

United States Patent [19]

Moll et al.

[11] Patent Number: 5,178,082

[45] Date of Patent: Jan. 12, 1993

[54] BLIND STITCH SEWING MACHINE

[75] Inventors: Philipp Moll, Aachen; Heinz-Wilhelm Dederichs, Wurselen, both of Fed. Rep. of Germany

[73] Assignee: J. Strobel & Sohne GmbH & Co., Fed. Rep. of Germany

[21] Appl. No.: 699,725

[22] Filed: May 14, 1991

[30] Foreign Application Priority Data

May 14, 1990 [DE] Fed. Rep. of Germany ..... 4015465

[51] Int. Cl.[5] ..... D05B 1/24

[52] U.S. Cl. ..... 112/178

[58] Field of Search ..... 112/176, 177, 178, 267.1, 112/268.1, 104

[56] References Cited

U.S. PATENT DOCUMENTS

| | | | |
|---|---|---|---|
| 1,552,405 | 9/1925 | Adams | 112/178 |
| 2,355,904 | 8/1944 | Buono | 112/178 |
| 4,688,500 | 8/1987 | Ichimura | 112/176 |
| 4,712,495 | 12/1987 | Jagielski | 112/176 |
| 4,718,365 | 1/1988 | Hauser et al. | 112/176 |
| 4,896,617 | 1/1990 | Hauser et al. | 112/176 |

FOREIGN PATENT DOCUMENTS

| | | |
|---|---|---|
| 1102535 | 9/1961 | Fed. Rep. of Germany . |
| 1660818 | 9/1975 | Fed. Rep. of Germany . |

*Primary Examiner*—Peter Nerbun

*Attorney, Agent, or Firm*—Bacon & Thomas

[57] ABSTRACT

A blind-stitch sewing machine has an elastic fabric bender to bulge the material to be sewed following each step of advance through an aperture of a throat plate into the arcuate path of motion of an arc needle pivoting to-and-fro transversely to the direction of advance of the material being sewed, and a stop for the bulged material mounted on the throat plate. The stop of the throat plate is designed for the purpose of sewing labels having unevenly thick rims onto the inside of finished garments along the label rim so that the arc needle pierces the edge of the label laid on the garment and emerges from the garment and the label rim is lifted off the garment at the stop so that only the garment is forced by the fabric bender against the stop.

13 Claims, 2 Drawing Sheets

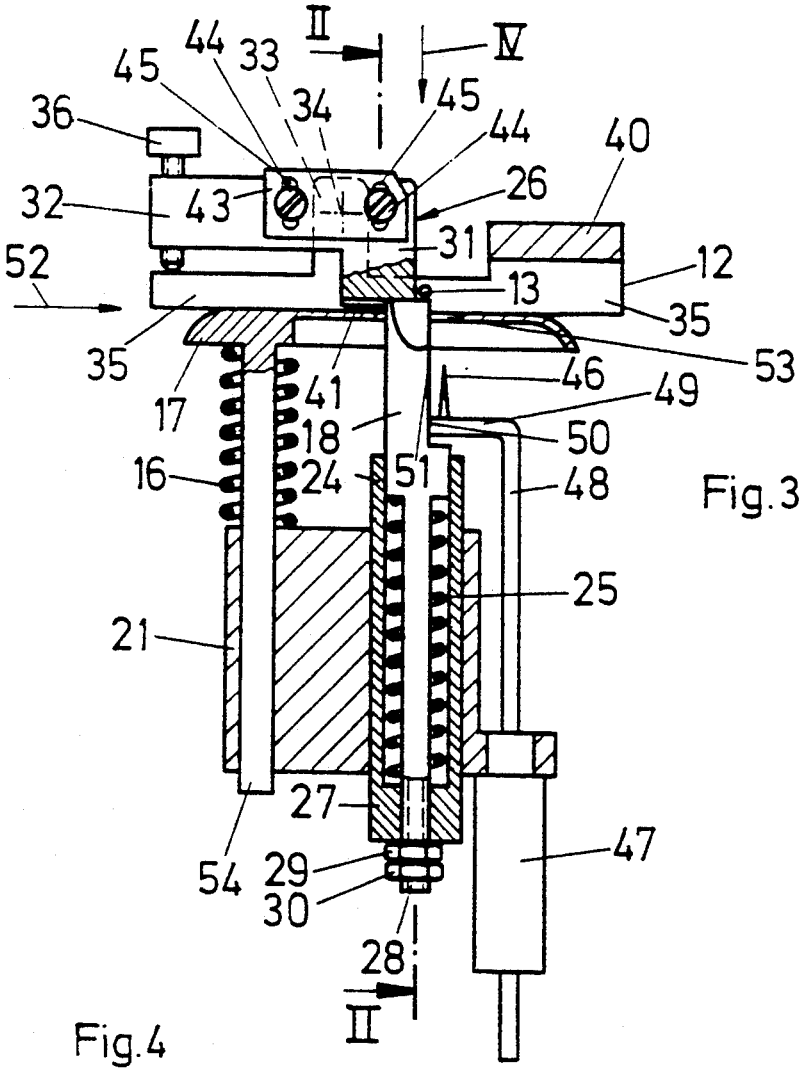
Fig.3
Fig.4
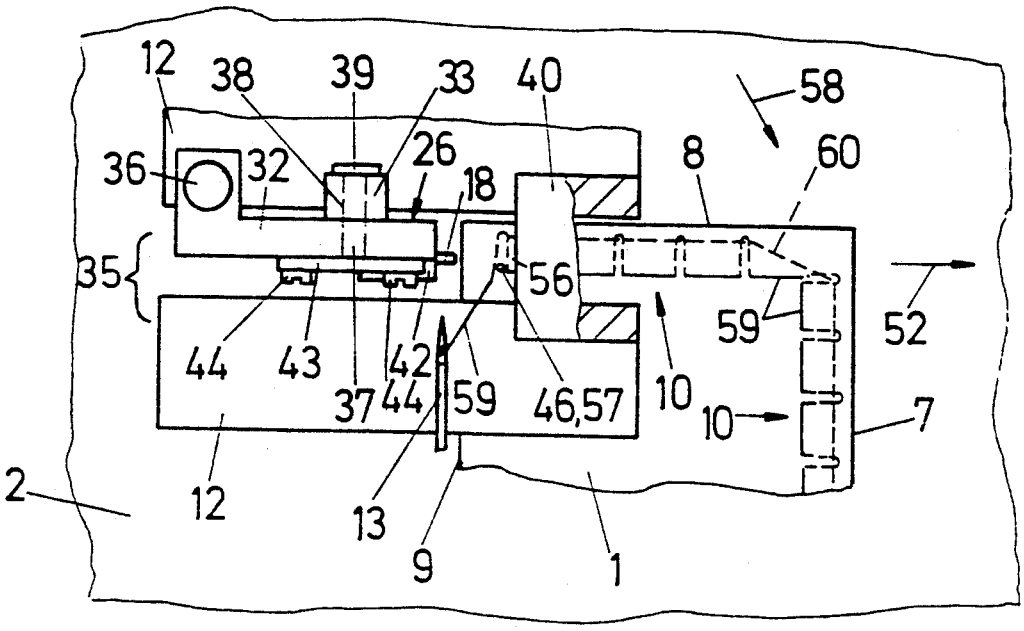

BLIND STITCH SEWING MACHINE

BACKGROUND OF THE INVENTION

The invention pertains to a blind-stitch sewing machine including a fabric bending arrangement which makes the fabric to be sewn bulge as it advances.

Blind-stitching machines are known as represented in German Patent No. 11 02 535. In this patent, the fabric bender is axially displaceable in a bearing sleeve against the opposing force of a helical compression spring mounted in this sleeve. The bias of the spring can be changed without thereby affecting the position of the fabric bender relative to the sleeve. The sleeve extends perpendicular to a throat plate mounted on the head of the blind-stitching machine and is axially displaceable to-and-fro on a fabric support arm of the machine by means of a drive shaft supported in said arm. The sleeve is connected to the drive shaft such that the minimum distance by which the sleeve may approach the throat plate when the machine is in operation can be changed. A stop, against which the fabric bender curves or bulges the material to be sewn, is pivotably supported by the throat plate on the side away from the fabric bender so as to pivot about an axis transverse to the direction of advance of the material being sewn or stitched. The stop can be adjusted by a setting screw engaging to stop and threaded into the throat plate in order to assure that the depth of stitching into the material being stitched by the arc needle pivoting to-and-fro on the side of the throat plate away from the fabric bender, which stitch depth is defined by means of the particular setting of the minimum distance between the driven sleeve and the throat plate, is maintained even when said material becomes transiently thicker. For the same purpose also, the bias of the helical compression spring loading the fabric bender can be set correspondingly.

Known blind-stitch sewing machines are not immediately suitable for the sewing of labels having an unevenly thick rim onto the inside of finished garments. There is no assurance that when sewing such a label along its rim, the arc-needle of the blind-stitching machine will always penetrate equally deep into the garment, such as, for example, when sewing a tetragonal label having two parallel edges folded over so that the label includes both single-ply label edges and the double-ply ones. This is, however, required to affix a label in a problem-free manner. If, for instance, the label is to be sewed onto a garment having a thin lining, the arc-needle may not penetrate the fabric layer covered by the thin lining, and on the other hand the arc-needle may not avoid stitching the lining.

Using straight needles, it is known to sew labels, cut from a band and of which both cut edges were folded, to the inside of finished garments, at all four label edges. In such arrangements, the needle perpendicularly and totally pierces both the label edges and the garment. As a drawback, the stitchings at the label edges are visible both on the label and also on the garment outside. Examples of such arrangements are represented by U.S. Pat. No. 2,560,186 and German Auslegeschrift 1,660,818. Moreover it is known, as disclosed in German Patent Nos. 3,515,189 and 3,519,849, to stitch labels spot-wise to garments by means of special blind-stitch sewing machines producing so-called point locks. These stitches are not visible on the garment outside.

SUMMARY OF THE INVENTION

The object of the present invention is to provide a blind-stitch sewing machine capable of sewing various polygon shaped labels of unevenly thick rims, especially rectangular or tetragonal labels with two folded parallel edges, in a problem-free manner to finished garments along the peripheral label edge or along all label edges.

The invention provides a blind-stitch sewing machine having an elastic fabric bender to bulge the material to be sewed following each step of advance through an aperture of a throat plate into the arcuate path of motion of an arc needle pivoting to-and-fro transversely to the direction of advance of the material being sewed, and a stop for the bulged material mounted on the throat plate. The stop of the throat plate is designed for the purpose of sewing labels having unevenly thick rims onto the inside of finished garments along the label rim so that the arc needle pierces the edge of the label laid on the garment and emerges from the garment and the label rim is lifted off the garment at the stop so that only the garment is forced by the fabric bender against the stop.

The invention will now be described with respect to a preferred embodiment of the blind-stitch sewing machine of the invention as illustrated in the following drawings.

BRIEF DESCRIPTION OF THE DRAWINGS

FIG. 3 is the section of the blind-stitching machine along line III—III of FIG. 2, but without the item to be sewed; and FIG. 4 is the elevation of the blind-stitching machine in the direction of the arrow IV in FIG. 3 but with the item to be sewed inserted during sewing.

DETAILED DESCRIPTION OF THE PREFERRED EMBODIMENT

Figure 1:
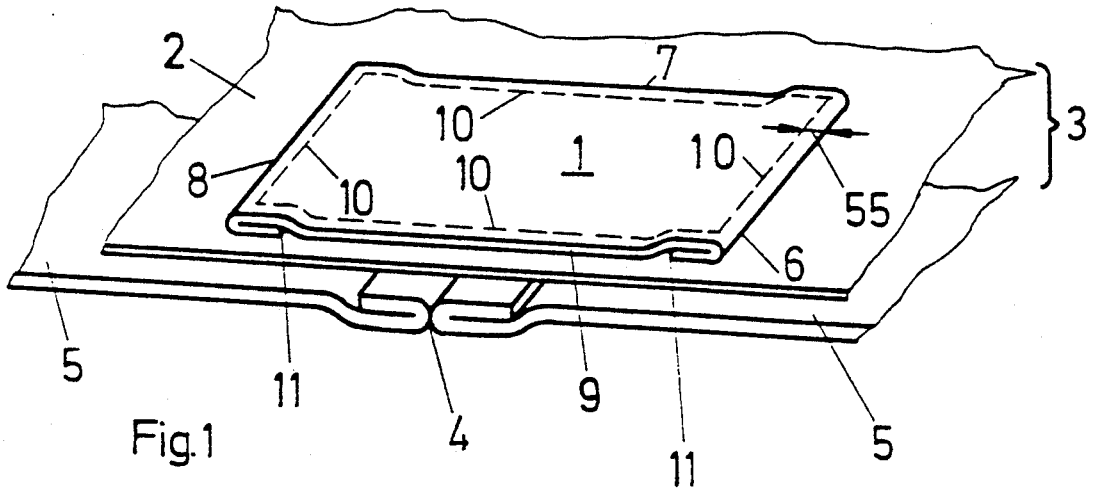
FIG. 1 is a perspective view of a label sewed by the blind-stitching machine of the present invention to an inside surface portion of a finished garment.
Figure 2:
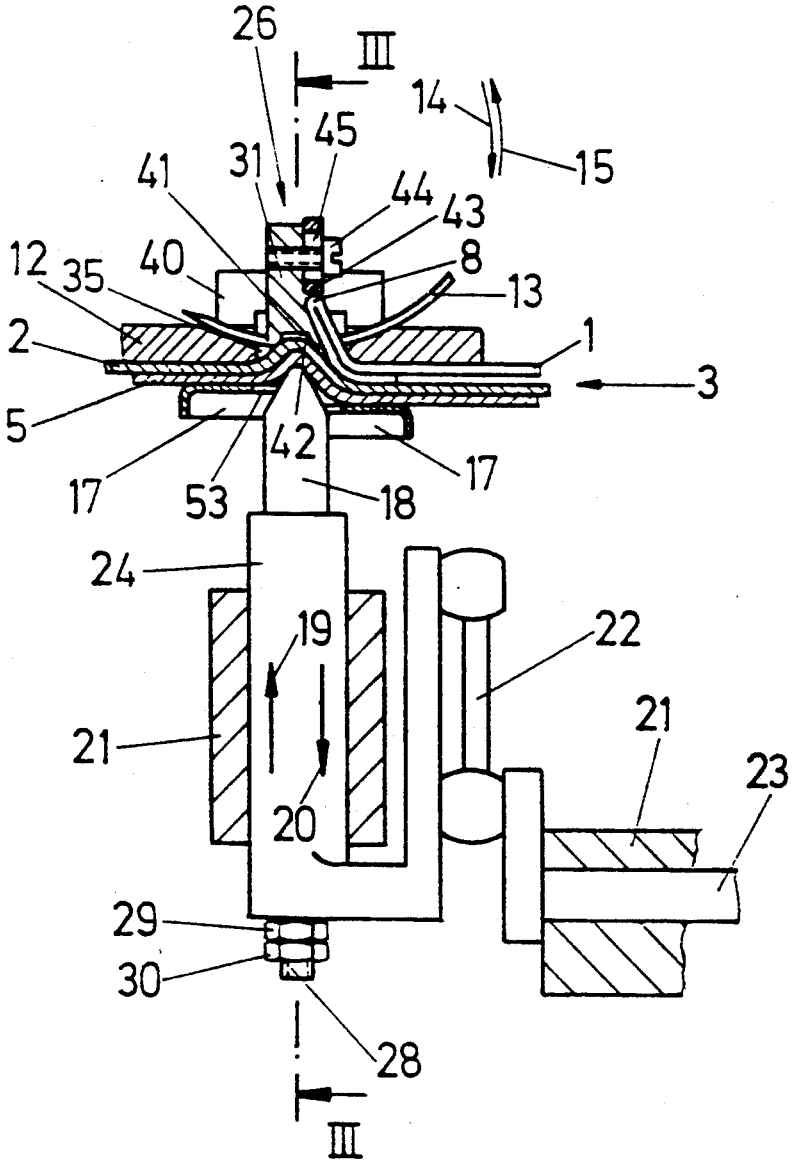
FIG. 2 is the section of the blind-stitching machine along line II—II of FIG. 3 with the item to be sewed inserted during sewing.

The blind-stitching machine arrangement illustratively shown in FIGS. 2 through 4 is employed to sew a rectangular label 1 as shown in FIG. 1 along all four label edges 6, 7, 8 and 9 by stitching 10 along each edge extending into the lining 2 of a coat 3 in the vicinity of the center back seam 4 of the outer coat fabric 5. The two long label edges 7 and 9 are single ply; the two cross-edges 6 and 8 are double-ply because the label is cut off a band and the two cut label edges 11 are folded. The sewn label 1 is transverse to the back seam 4 of the outer coat fabric 5.

With reference to FIGS. 2 and 3, the blind-stitching machine comprises a throat plate 12 and an arc-needle 13 pivoting to-and-fro above the throat plate 12 along an arcuate path in the direction of the arrows 14 and 15 when the machine is operating. The throat plate 12 and the arc-needle 13 are mounted on the head of the sewing machine.

The blind-stitching machine also comprises a fabric presser plate 17 loaded by a helical compression spring 16 toward the throat plate 12 and a fabric bender 18 extending perpendicular to throat plate 12. Fabric bender 18 moves rectilinearly to-and-fro in the direction of the arrows 19 and 20 when the machine is operating.

The fabric presser plate 17 and the fabric bender 18 are present at the free end of a machine fabric support arm 21 which end provides a rest for the helical compression spring 16 of the fabric presser plate 17. Both the fabric presser plate 17 and the free end of the fabric support arm 21 project underneath the head of the blind-stitching machine.

The fabric bender 18 is axially displaceble against the force of a helical compression spring 25 located inside a bearing sleeve 24. Sleeve 24 is axially displaceable relative to fabric support arm 21 by rotation of a drive shaft 23 having an integrally formed drive lever (not labeled) connected to an extension of sleeve 24 through a drive link 22. Fabric bender 18 cooperates with a stop 26 on the throat plate 12 as clearly shown in FIG. 2. The bias of the helical compression spring 25 mounted in the sleeve 24 can be changed by means of an adjustment nut 29 present on a threaded end of shank 28 of the fabric bender 18 which projects from base 27 of sleeve 24. A locking nut 30 is also threaded on the end of the shank 28 in order to lock nut 29 at the desired biasing position.

As shown in FIGS. 3 and 4, stop 26 is L-shaped and comprises a first arm 31 and a second arm 32 positioned orthogonal to each other. The throat plate 12 comprises a projection 33 on the side away from the fabric bender 18 and projection 33 provides a pivot axis 34 for stop 26. Stop 26 is arranged such that first arm 31 enters a slot 35 of the throat plate 12 in the direction of the fabric bender 18 with the second arm 32 of the stop 26 being approximately parallel to the throat plate 12 and resting, by means of an adjustment screw 36, against the throat plate 12. Adjustment screw 36 is screwed into a threaded borehole (not labeled) located at the free end of second arm 32. In order to permit pivoting, stop 26 is provided with a bolt 37 having a head 39 and received in a corresponding borehole 38 at the free end of the projection 33. The throat plate 12 further comprises a bridge 40 spanning, at the end away from the adjustment screw 36, the slot 35 of the throat plate 12 which is transverse to the pivot axis 34 of the stop 26.

As best shown in FIG. 2, the free end of the fabric bender 18 is designed conically to taper transversely to the slot 35 of throat plate 12. First arm 31 of the stop 26 comprises a groove 41 at the free end facing the top of fabric bender 18. Groove 41 extends parallel to slot 35 and is bounded on the right side of FIG. 2 by a beak 42 slanting from the right downward and being part of first arm 31. Stop 26 comprises a guide strip 43, as shown on the right side of FIG. 2, which extends parallel to its second arm 32 (FIG. 3). The spacing of guide strip 43 from the lateral beak 42 of first arm 31 is adjustable by means of two screws 44 which affix guide strip 43 to stop 26. Each screw 44 passes through an elongated slot 45 located in the guide strip 43 parallel to first arm 31.

In addition to the fabric presser plate 17 and the fabric bender 18, the fabric support arm 21 of the blind-stitching machine comprises a fixing needle 46 extending parallel to fabric bender 18 and on the right side thereof, as shown in FIG. 3. Fixing needle 46 can be moved by means of a compressed-air actuator 47 toward slot 35 of throat plate 12, the compressed-air actuator 47 being arranged to displace a support 48 comprising an arm 49 supporting fixing needle 46 and bent-off at a right angle to fabric bender 18 and resting by its end face 50 transverse to the fabric bender 18 against an upright side surface 51 of fabric bender 18. Arm 49 abutting side surface 51 of fabric bender 18 prevents rotation of fabric bender 18 in bush or sleeve 24.

When the label 1 is affixed to the coat 3, first the label edge 6, then the label edge 7, next the label edge 8 and lastly the label edge 9 are sewed onto the lining 2 of the coat 3, each by a stitching 10. The coat 3 and the label 1 are placed into the blind-stitching machine and are rotated by a right angle at the end of each of the first three stitchings 10 so that the four label edges 6, 7, 8 and 9 consecutively move past the stop 26 of throat plate 12 on the right side of stop 26 as shown in FIG. 2.

In the course of each stitching 10, the coat 3 and the label 1 are advanced in conventional stepwise manner in the direction of the arrow 52 (FIGS. 3 and 4). Following each step of advance, the elastic fabric bender 18 makes the coat 3 bulge through the aperture of the throat plate 12 formed by slot 35 extending in the direction of advance 52. This presses the coat 3 against stop 26 of throat plate 12, namely into groove 41 of first arm 31 of stop 26, while the label edge 6 or 7 or 8 or 9 is separated by beak 42 of first arm 31 of stop 26 from lining 2 of coat 3. Beak 42 enters between lining 2 and label edges 6, 7, 8 and 9 respectively. The spring-loaded fabric-presser plate 17, which comprises an aperture 53 for fabric bender 18 and a foot 54 axially displaceable in fabric support arm 21 of the blind-stitching machine, forces coat 3 and label 1 against throat plate 12 as shown clearly in FIG. 2, wherein the two segments of fabric presser plate 17 on each side of fabric bender 18 are shown to be correspondingly mutually offset in height. Alternatively, fabric presser plate 17 may consist of two parts mounted to the right and left in FIG. 2 of the fabric bender 18 with each being independently displaceable vertically relative to throat plate 12.

The arc-needle 13 pivots to-and-fro transversely to the direction of advance 52. Upon each step of advance, arc-needle 13 pierces label edge 6, 7, 8 or 9 that has been lifted by beak 42 of stop 26 from the coat 3 or its lining 2 and that rests against guide strip 43 of stop 26. Strip 43 is also located on the side of the stop 26 facing the arc-needle 13 when arc-needle 13 pivots into the piercing direction 14. After label edge 6, 7, 8 or 9 has been pierced, the arc-needle 13 pierces lining 2 of coat 3 at the apex of the bulge caused by the fabric bender 18 and emerges from lining 2, as shown in FIG. 2. Then, arc-needle 13 pivots back in the direction of arrow 15 as shown in FIG. 2.

Stop 26 of throat plate 12 is set by means of adjustment screw 36 so that arc-needle 13 reliably dips into only the lining 2 of coat 3, not the outer material 5 of the coat. Guide strip 43 of stop 26 is adjusted so that the desired spacing 55 between each stitching 10 and the pertinent label edge 6, 7, 8 or 9 is obtained (FIG. 1).

Fixing needle 46 is employed when coat 3 and label 1 are rotated about a right angle at the end of each of the three stitchings 10 along the first, second, third label edges 6, 7 and 8 respectively. For example, if edges 6, 7 and 8 of label 1 have been sewn to lining 2 of coat 3, the last stitch 56 has been competed, and coat 3, as well as label 1, have been advanced by one step in the direction of arrow 52, as represented in FIG. 4, said advancing being effected during the pivoting motion of the arc-needle 13 in the direction of arrow 15 after having left label edge 8 and during its ensuing pivoting motion in the direction of arrow 14 in FIG. 2 into the position shown in FIG. 4 which is shortly ahead of the piercing position, the blind-stitch sewing machine is stopped, and the compressed air actuator 47 is actuated in order to move fixing needle 46 so that it enters at least coat 3 or its outer fabric 5 and lining 2 at the site of the last arc-needle piercing point 57. That is, fixing needle 46 enters below the point where the arc-needle 13 last pierced label edge 8. Finally, fabric presser plate 17 is moved away by a compressed-air actuator (not shown) from throat plate 12 in order to release coat 3 and label 1. At this point, the operator(s) can rotate coat 3 and label 1 ninety degrees about fixing needle 46 in the direction of arrow 58 of FIG. 4, and the fourth label edge 9 can be sewed onto lining 2 of coat 3. This stitching will continuously join stitching 10 of the third label edge 8 with the needle thread 59 and the bobbin thread 60 of the double lock stitch-blind-stitch sewing machine passing between these two stitchings in the manner shown in FIG. 4 for the two stitchings 10 of the second and third label edges 7 and 8 respectively.

Although disclosed with respect to a particular embodiment of the invention, it is to be understood that various changes and/or modifications may be made without departing from the spirit of the invention as defined by the following claims.

We claim:

1. A blind-stitching machine for sewing a label along the edges thereof to the inside of a garment, said machine comprising:

an arc-needle pivoting to-and-fro along an arcuate path transversely to a direction in which the garment and the label are advanced step-by-step;

a throat plate having an aperture therethrough;

a stop mounted on the throat plate;

a fabric-bender to make the garment bulge, after each advance step, through the aperture of the throat plate, into the arcuate path of motion of the arc-needle, against the stop mounted on the throat plate; and means for separating the label edge being sewn from the garment at the stop so that the pivoting arc-needle pierces the edge and emerges from the garment, whereby a label with edges of different thickness can be sewn onto a garment.

2. A blind-stitching machine as claimed in claim 1, wherein the stop of the throat plate comprises a beak disposed to be operable between the label edge and the garment on the side facing the arc-needle when the needle pivots in the direction of stitching in order to separate the label from the garment.

3. A blind-stitching machine as claimed in claim 2 wherein said stop includes means for guiding the label edge on the side facing the arc-needle when said needle pivots in the direction of stitching.

4. A blind-stitching machine as claimed in claim 3, wherein said means for guiding the label edge comprises a guide strip, said guide strip being adjustable to allow setting the stitching distance from the label edge.

5. A blind-stitching machine as claimed in claim 1 wherein said stop is adjustable to set the stitch depth of the arc-needle into the garment.

6. A blind-stitching machine as claimed in claim 3 wherein said stop is adjustable to set the stitch depth of the arc-needle into the garment.

7. A blind-stitching machine as claimed in claim 4 wherein said stop is adjustable to set the stitch depth of the arc-needle into the garment.

8. A blind-stitching machine as claimed in claim 1 further comprising means for rotating the garment and the label by a predetermined angle determined by the number of edges of said label at the end of each edge of the label while enabling the ensuing stitch on the next edge to be sewn to follow the formation of the last stitch on the prior sewn edge.

9. A blind-stitching machine as claimed in claim 8 wherein said means for rotating the garment and label comprises a fixing needle which can be actuated to pierce the garment at the site of the last stitch on the prior sewn edge.

10. A blind-stitch sewing machine as claimed in claim 9, wherein said fabric bender is perpendicular to said throat plate and moves to-and-fro in rectilinear manner and said fixing needle is mounted adjacent said fabric bender on a support contacting the fabric bender to prevent rotation thereof.

11. A blind-stitching machine as claimed in claim 9 wherein said fixing needle is driven by a compressed-air actuator.

12. A blind-stitching machine as claimed in claim 9, further including a spring-loaded fabric presser plate for forcing the garment and the label against said throat plate on a side of said throat plate which faces said fabric bender, said fabric presser plate being liftable from said throat plate for the purpose of rotating the garment and the label following actuation of the fixing needle.

13. A blind-stitching machine as claimed in claim 12 wherein said fabric presser plate can be lifted off said throat plate by means of a compressed air actuator.

* * * * *